US005249403A

United States Patent [19]

Neilly et al.

[11] Patent Number: 5,249,403

[45] Date of Patent: Oct. 5, 1993

[54] WINDOW FRAME CONNECTOR

[75] Inventors: Albert J. Neilly, Holland; K. William Kennedy, Lowell, both of Mich.

[73] Assignee: ODL, Incorporated, Zeeland, Mich.

[21] Appl. No.: 862,301

[22] Filed: Apr. 2, 1992

Related U.S. Application Data

[62] Division of Ser. No. 582,483, Sep. 14, 1990, Pat. No. 5,133,168.

[51] Int. Cl.[5] ..... E04C 3/00

[52] U.S. Cl. ..... 52/585; 52/455; 24/545; 24/573.1

[58] Field of Search ..... 52/211, 214, 217, 476, 52/585, 455; 49/502, 506, DIG. 1, DIG. 2; 24/545, 563, 573.1

[56] References Cited

U.S. PATENT DOCUMENTS

| | | | |
|---|---|---|---|
| 3,191,727 | 6/1965 | Schmeltz | 49/DIG. 1 |
| 3,760,543 | 9/1973 | McAllister | 52/397 |
| 3,903,669 | 9/1975 | Pease | 52/585 |
| 4,021,957 | 5/1977 | Mulder | 52/824 |
| 4,306,373 | 12/1981 | Chatani | 446/124 |
| 4,919,635 | 4/1990 | Bertrand | 446/128 |

*Primary Examiner*—Carl D. Friedman
*Assistant Examiner*—Creighton Smith
*Attorney, Agent, or Firm*—Warner, Norcross & Judd

[57] ABSTRACT

A window frame connector having a generally tubular body to fit over aligned screw bosses of opposite window frame halves to align and releasably intersecure the frame halves for transportation. The connector includes a pair of diametrically opposed longitudinal slots in each of its opposite ends. The slots in the two ends are longitudinally aligned. Either connector end may be pinched to open the opposite end, and the connector slots receive ribs supporting the interconnected screw bosses.

3 Claims, 2 Drawing Sheets

WINDOW FRAME CONNECTOR

This is a division of application Ser. No. 07/582,483, filed Sep. 14, 1990 now U.S. Pat. No. 5,133,168.

BACKGROUND OF THE INVENTION

The present invention relates to window frame connector for temporarily intersecuring a window assembly for storage and/or transportation.

Window assemblies are typically manufactured at one location and installed, for example in a door, at a second location. Relatively simple window assemblies include an insulated glass and a pair of frame halves sandwiching the glass for support within an article, such as a door. Such window assemblies for doors are known as door lights.

The insulated glass includes a pair of transparent panes separated by and hermetically sealed to a spacer frame. The void between the panes can be occupied by air, a vacuum, or a selected gas. Desiccant is provided within the spacer frame to ensure that moisture between the panes is absorbed. Relative slippage of the glass panes in the insulated glass must be avoided, or even eliminated, to prevent rupture of the hermetic seal. Rupture of the seal will permit moisture to enter the space or gas to leave the space, which seriously detracts from the function and/or aesthetics of the window.

It is therefore desirable to align and intersecure the frame halves of the sandwiched assembly during transportation to prevent such relative slippage. One such window frame connector is illustrated in FIG. 8 (labeled "Prior Art") and includes a planar body having a pair of opposed slots therein. The connector is fitted over a rib in each of the injection molded frame halves to align and partially intersecure the frame halves. Although the connector prevents movement in a direction generally transverse to its body, it does not prevent relative movement in a direction generally perpendicular to its body. Consequently, the connectors must be used around all four edges of the assembly and even then do not always prevent slippage. Further, the connector is easily dislodged during installation and/or shipment.

Although the frame halves can be more permanently intersecured, for example using the mounting screws, this is labor intensive. First, the screws must be fully inserted during assembly, then removed for separation of the frame halves for installation in an article, and then reinserted and tightened after the window is installed in the desired article.

SUMMARY OF THE INVENTION

The aforementioned problems are overcome in the present invention wherein a window frame connector encapsulates screw bosses on the opposite frame halves to securely align and interconnect the frame halves for storage and/or transportation. More particularly, the connector is a generally tubular body having opposite open ends designed to fit over the opposed screw bosses. Preferably, the connector is bifurcated at its opposite ends to provide flexibility and also fit over ribs supporting the screw bosses. Even more preferably, the interior edges of the ends are chamfered and the corners of the bifurcated ends are rounded to facilitate installation of the connector over the screw boss and rib.

When the connector is fabricated of a resiliently deformable material, one of the bifurcated ends can be pinched during installation to open the opposite bifurcated end to further facilitate installation of the window frame connector over the screw boss.

The present connector, particularly in its preferred embodiments, securely aligns and intersecures the window assembly. The connector is easily installed and removed and improves protection for the insulated glass of the assembly.

These and other objects, advantages, and features of the invention will be more readily understood and appreciated by reference to the detailed description of the preferred embodiment and the drawings.

DETAILED DESCRIPTION OF THE PREFERRED EMBODIMENT

Figure 1:
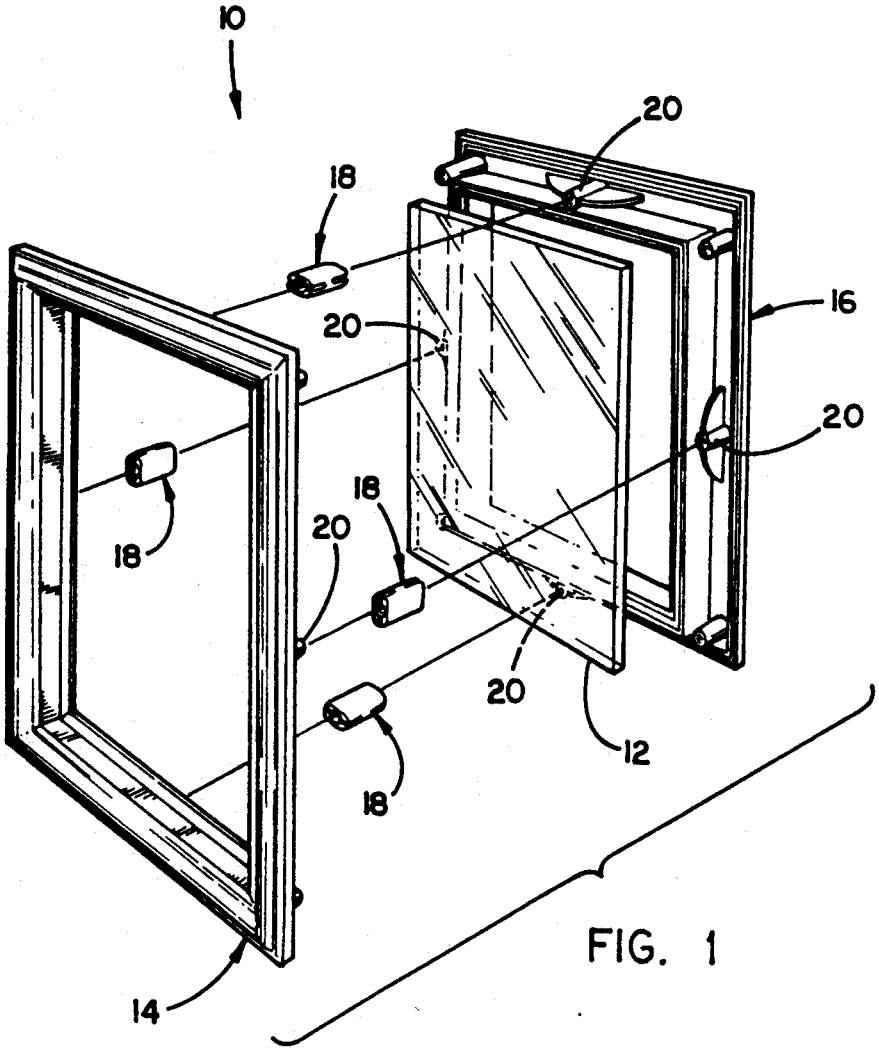
FIG. 1 is a perspective exploded view of a window assembly including the window frame connectors of the present invention.
Figure 2:
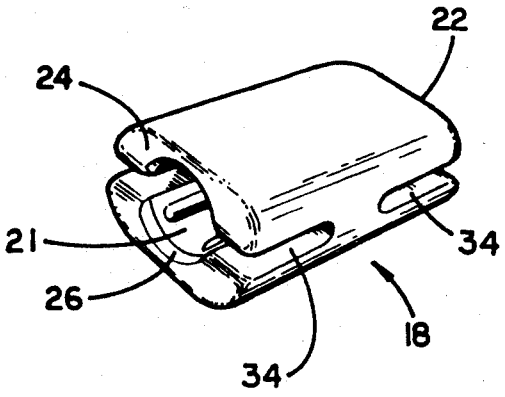
FIG. 2 is a perspective view of the window frame connector.

A window assembly suitable for use with the window frame connector of the present invention is illustrated in FIG. 1 and generally designated 10. The assembly includes an insulated glass panel 12 and a pair of frame halves 14 and 16. The window halves 14 and 16 include opposed screw bosses 20, which ultimately receive screws (not shown) to secure the window assembly within an article, such as a door. The screw bosses are supported by diametrically opposed ribs 21 extending therefrom and integral therewith. During manufacture and initial assembly, the window frame connectors 18 are used to temporarily, but securely, align and interconnect the opposed screw bosses 20 to hold the assembly together for subsequent transportation and/or storage without glass slippage.

The window frame connector 18 is illustrated in detail in FIGS. 2–6. Preferably, the connector is fabricated of a resiliently deformable material such as a high-density polyethylene. The connector 18 is generally tubular throughout its length defining an interior wall 21 and terminating in a pair of opposed ends 22 and 24. The tubular shape is somewhat flattened from cylindrical as most clearly illustrated in FIGS. 2 and 5 to provide additional wall strength for the fulcrum portion 32. The inner edge 26 of each end 22 and 24 is chamfered to provide a ramp surface to facilitate reception of the connectors over the screw bosses as will be described. Four longitudinal pressure ribs 27 extend radially inwardly from the inner wall and extend between the chamfered edges 26.

Figure 4:
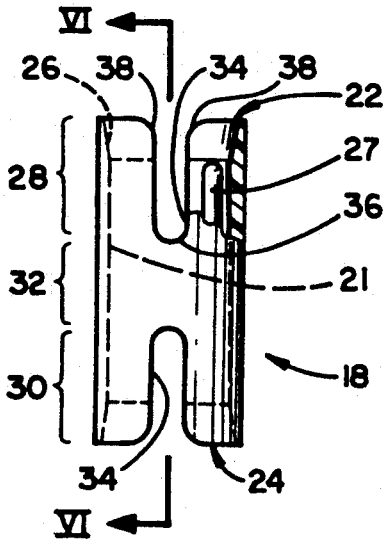
FIG. 4 is a side elevational view, partially in section, of the window frame connector.
Figure 5:
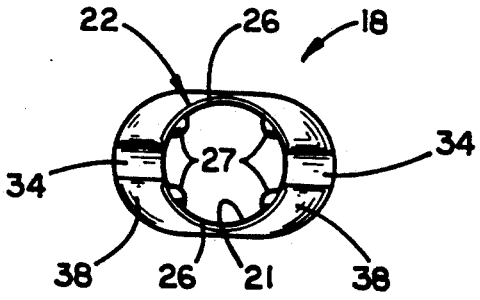
FIG. 5 is an end view of the window frame connector.
Figure 6:
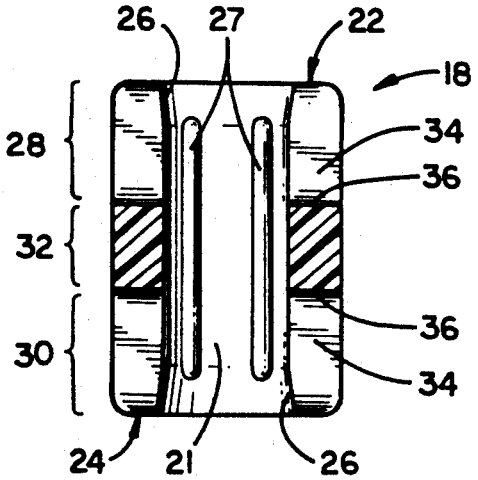
FIG. 6 is a sectional view taken along line VI—VI in FIG. 4.
Figure 8:
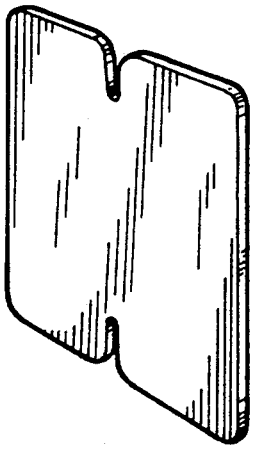
FIG. 8 (PRIOR ART)
FIG. 8 illustrates the prior art window frame connector discussed above.

The connector 18 includes end portions 28 and 30 adjacent ends 22 and 24, respectively, and a fulcrum portion 32 therebetween (see FIGS. 4 and 6). Each of the end portions 28 and 30 is bifurcated to define a pair of longitudinal, diametrically opposed slots 34. Each slot 34 extends the full length of the end portion 28 or 30 and terminates in a rounded end 36. The slots 34 in the two end portions 28 and 30 are longitudinally aligned. The corners 38 of the bifurcated ends adjacent the slot 34 are rounded, again to facilitate installation as will be described. Consequently, the mouth of each slot adjacent the ends 22 and 24 are wider than the remainder of the slot.

Figure 7:
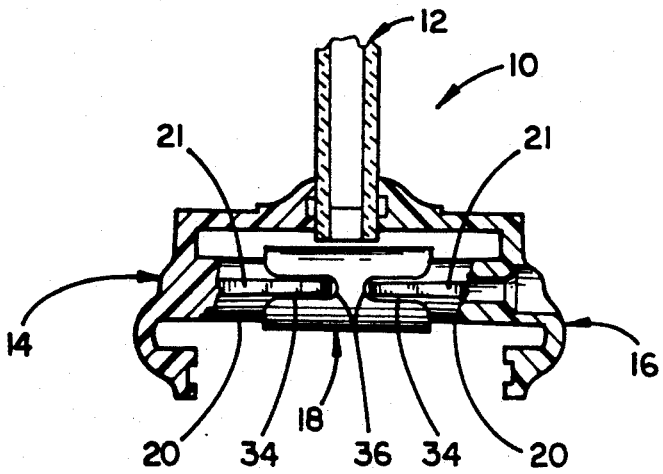
FIG. 7 is a sectional view of the frame assembly with the window frame connector installed.

The use of the window frame connectors 18 is illustrated in FIGS. 1 and 7. Prior to installation of the connectors 18, the frame halves are manufactured using well-known techniques, for example, by injection molding. Each frame half is therefore preferably an integral piece including screw bosses 20 and supporting ribs 21. The insulated glass 12 is also manufactured using well-known techniques.

To assemble a window 10 for shipment, one of the frame halves 14 is horizontally supported. The insulated glass is then laid in position on the frame half 14. Of course, single-pane glass may be substituted for the insulated glass if desired. Often, the screw bosses 20 provide the lateral alignment of the insulated glass 12 on the frame half.

Figure 3:
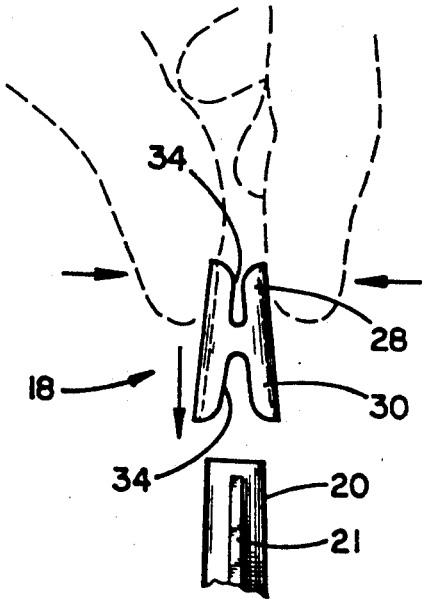
FIG. 3 is a side elevational view of the window frame connector being installed on a screw boss.

At this point of the assembly, the window frame connectors 18 are installed on at least any two of the screw bosses 20. The preferred method of installation is illustrated in FIG. 3. Preferably, one end portion 28 of the connector 18 is pinched to open the opposite end portion 30. When so held, the connector 18 is inserted over the screw boss 20 with the slots 34 aligned with the ribs 21 to receive the ribs therein. The chamfered inner edge 26 (see FIG. 4) eases installation of the connector 18 over the screw boss 20. Additionally, the rounded corners 38 (again see FIG. 4) engage the ribs 21 as necessary to cause slight rotation of the connector 18 for alignment of the slots 34 with the ribs 21. The connector 18 is pushed over the screw boss 20 until the bottom 36 of the slots 34 engages the ribs 21. The connector end 28 is then released so that the end portion 30 securely grips the mounted screw boss 20. The pressure ribs 27 increase the gripping force on the screw boss.

The number of connectors used will depend on several factors including the size and weight of the glass. As few as two connectors can be used on small windows, and more will be required on large windows.

With the window frame connectors 18 so installed, the second frame half 16 is aligned with the first frame half 14. Particularly, the corresponding screw bosses 20 of the second frame half 16 are aligned with the window frame connectors 18 mounted on the first frame half 14. When so aligned, the second frame half 16 is pushed down toward the first frame half 14 so that its screw bosses 20 pass into the window frame connectors 18. Again, the chamfered edges 26 and the rounded corners 38 facilitate movement of the screw boss 20 and its associated ribs 21 into each window frame connector 18.

The window 10 assembled for transportation and/or shipment is illustrated in FIG. 7. Optionally, the window assembly 10 is also banded or strapped (not shown) to further hold the constituent elements together. However, banding or strapping is not required—a distinct benefit of the invention. The windows are then shipped to a location for installation within an article, such as a door.

The door manufacturer will snip the bands if present and separate the frame halves 14 and 16. Each window frame connector 18 will remain mounted on one of the screw bosses 20 after the frame halves are separated. However, not all window frame connectors 18 will necessarily remain on either one of the frame halves. In any event, the installer preferably removes all of the window frame connectors and reassembles the window assembly within an article, such as a door, by inserting screws (not shown) through the bosses in conventional fashion. Although the installer may discard the window frame connectors, it is preferred that the clips be collected and retained for shipment back to, and reuse by, the window manufacturer. It is also possible to simply leave the connectors on the screw bosses in the assembled window.

The present window frame connector provides a simple, secure, and temporary means of aligning and intersecuring the window assembly 10 for transportation and shipment prior to final installation within an article. The encapsulation of screw bosses on the opposite window frames greatly reduces the likelihood of relative lateral movement of the window frames during transportation and storage. Such reduced movement leads to enhanced integrity of the insulated glass and therefore less loss and more satisfied consumers.

The above description is that of a preferred embodiment of the invention. Various alterations and changes can be made without departing from the spirit and broader aspects of the invention as set forth in the appended claims, which are to be interpreted in accordance with the principles of patent law including the doctrine of equivalents.

The embodiments of the invention in which an exclusive property or privilege is claimed are defined as follows:

1. A window frame connector for releasably aligning and intersecuring two window frame halves for transportation, each of the frame halves including a boss supported by a pair of opposite ribs, said window frame connector comprising a generally tubular body having a pair of opposite ends for receiving the bosses, said body defining a pair of diametrically opposed longitudinally slots extending into said body from each of said ends for receiving the boss ribs, said slots from said opposite ends being longitudinally aligned, each of said ends including an interior edge which is chamfered to ease installation of said connector onto one of the bosses, each of said slots including a mouth wider than the remainder of said slot to facilitate reception of the boss ribs into said slots.

2. A window frame connector comprising a generally tubular body of a resiliently flexible material, said body including a pair of opposite end portions and a fulcrum portion between said end portions, each of said end portions defining a pair of diametrically opposed longitudinal slots, said slots in said opposite end portions being longitudinally aligned, whereby one of said end portions can be pinched to open the other of said end portions to facilitate installation of said other end portion over a boss.

3. A method of assembling a window assembly for transportation, said method comprising:

mounting a generally tubular window frame connector over a screw boss on a first frame half with a first longitudinal slot on the connector receiving a rib supporting the boss;

aligning a screw boss of a second frame half with the cylindrical window frame connector; and forcing the screw boss of the second frame half into the window frame connector with a second longitudinal slot on the connector receiving a rib supporting the boss, whereby the connector releasably intersecures the bosses and therefore the frame halves.

* * * * *